US007150176B2

(12) United States Patent
Thomas

(10) Patent No.: US 7,150,176 B2
(45) Date of Patent: Dec. 19, 2006

(54) VEHICLE FRAME ATTACHMENT APPARATUS METHOD AND SYSTEM

(76) Inventor: Desmond R. Thomas, 155 W. 1400 South, Perry, UT (US) 84302

( * ) Notice: Subject to any disclaimer, the term of this patent is extended or adjusted under 35 U.S.C. 154(b) by 22 days.

(21) Appl. No.: 10/864,676

(22) Filed: Jun. 9, 2004

(65) Prior Publication Data

US 2005/0092057 A1 May 5, 2005

Related U.S. Application Data

(60) Provisional application No. 60/516,227, filed on Oct. 31, 2003.

(51) Int. Cl.
*B21D 43/10* (2006.01)

(52) U.S. Cl. ..... 72/422; 72/457; 72/705

(58) Field of Classification Search ..... 72/705, 72/308, 447, 457, 422; 269/266, 154, 265
See application file for complete search history.

(56) References Cited

U.S. PATENT DOCUMENTS 2,744,430 A * 5/1956 McLaughlin et al. ..... 269/137
4,337,636 A * 7/1982 Clausen ..... 72/457
6,272,898 B1 * 8/2001 Soyk ..... 72/311

* cited by examiner

*Primary Examiner*—Lowell A. Larson
*Assistant Examiner*—Teresa M. Bonk
(74) *Attorney, Agent, or Firm*—Michael R. Schramm

(57) ABSTRACT

A vehicle frame attachment apparatus encompasses a vehicle frame and efficiently distributes the holding or pulling forces involved in aligning a vehicle frame. The frame attachment apparatus includes a vise and a containment mechanism that secures the vehicle frame within the vise. In one embodiment, the vise includes an opposable member and a set of grasping digits that conform to bends in the vehicle frame. An alignment device may be connected to the vise to exert a pulling force and thereby align the vehicle frame. The disclosed vehicle frame alignment apparatus is easy to deploy, and reduces the risk of damaging a vehicle or injuring an alignment technician.

13 Claims, 7 Drawing Sheets

VEHICLE FRAME ATTACHMENT APPARATUS METHOD AND SYSTEM

RELATED APPLICATIONS

This application claims the benefit of U.S. Provisional Application 60/516,227 Entitled "VEHICLE FRAME ATTACHMENT APPARATUS METHOD AND SYSTEM" filed on Oct. 31, 2003 for Desmond R. Thomas.

BACKGROUND OF THE INVENTION

1. Field of the Invention

The present invention relates to the field of vehicular frame alignment devices, methods, and systems. More particularly, the invention relates to devices, methods, and systems for attaching retaining devices to structural frames of vehicles to facilitate frame alignment.

2. Description of the Related Art

Vehicle frames are often subjected to tremendous stresses and strains, particularly during accidents and off-road excursions. As a result, vehicle frames are frequently distorted, resulting in poor driving performance and additional vehicle stress, including tire wear. In some cases, a frame may be bent to the point that the vehicle is no longer functional.

To correct frame distortion, selected locations of a vehicle frame are held in place and secured from movement, while pulling forces are applied at other carefully selected locations. To anchor the vehicle frame securely, clamping devices are typically positioned on an alignment platform and engaged to secure the frame firmly to the alignment platform. Placing the vehicle on the alignment platform secures the vehicle in an effective manner and facilitates access to frame members located underneath the vehicle.

Once securely positioned on the platform, pulling devices may be attached to the frame in order to apply a correctional force—generally in a lateral direction around the perimeter of the frame—in order to pull or bend the frame back into alignment. Typically, a clamp is attached to the frame and connected via a chain, or the like, to a hydraulic pulling mechanism such as a pulling tower. Upon activation of the hydraulic pulling mechanism the frame is pulled into alignment.

To facilitate a proper alignment, vehicle manufacturers often provide specifications for the correct three-dimensional location of specific reference points, such as reference openings or holes. If a vehicle frame is distorted, the reference points will be located away from their normal position. Aligning a vehicle frame requires returning the vehicle reference points to their specified normal positions.

Tremendous pulling forces are typically required to pull a frame into alignment. Prior art frame attachment devices such as hooks or clamps may slip or release from the frame resulting in considerable danger and risk to the operator as well as damage to the vehicle. As a result of these risks, the cost of operating alignment equipment is significantly increased.

Historically, nearly all vehicles had structural frames on which vehicles including body panels were built. Repairing vehicle damage involved straightening the frame, and reshaping or replacing body panels. Recently, however, many vehicles are being built using "unibody" construction techniques in order to lower manufacturing costs and reduce body weight and fuel consumption.

With unibody vehicles, body members and panels are typically joined and welded at a perpendicular seam known as a "pinch weld." The pinch weld increases the strength of the vehicle body and essentially functions as a frame member. Consequently, the pinch weld seams of a unibody vehicle are often referred to as a "frame" in that the pinch weld seams function as a perimeter support structure that requires alignment after being distorted as a result of the vehicle being involved in a collision or the like.

With the growth of unibody vehicles, vehicle alignment platforms and devices are typically optimized for use with pinch weld frames. For example, platform clamps that are used to secure portions of a vehicle frame to the platform are typically vises that may be tightened about a pinch weld seam in order to firmly secure a portion of the frame in place during alignment.

While many vehicles are manufactured with unibody construction techniques, a considerable number of vehicles, particularly trucks and sport utility vehicles, employ a separate structural frame for at least a portion of the vehicle support system. Attachment devices and methods for structural frames are currently less effective and less safe than attachment devices and methods for pinch weld frames.

Additionally, due to the forces required to align vehicle frames, particularly structural vehicle frames, prior art attachment and clamping devices are often heavy and require tightening and loosening of a large number of bolts. The strain of securing and removing prior art attachment and clamping devices often wears down or injures technicians, resulting in reduced productivity, increased sick time, and shortened careers.

What is needed are devices and methods for working with structural frame members in a safe, efficient, cost-effective manner. In particular, what is needed are devices and methods for attaching to structural frame members in a manner that a selected portion of a structural frame may be safely and effectively anchored to a platform, or attached to a pulling device and moved, in order to align a vehicle frame without straining or injuring a technician or operator.

SUMMARY OF THE INVENTION

The present invention has been developed in response to the present state of the art, and in particular, in response to the problems and needs in the art that have not yet been fully solved by currently available vehicle frame attachment devices and methods. Accordingly, the present invention provides an improved apparatus, method, and system for aligning vehicular structural frames that overcomes many or all of the above-discussed shortcomings in the art.

In one aspect of the present invention, a frame attachment apparatus includes a vise that clamps onto a portion of a vehicle frame member, a containment mechanism that secures the vehicle frame member within the vise, and a connection member fixably attached to the vise. The vise provides lateral stability to a portion of a structural frame, while the containment mechanism provides vertical stability to the portion of the frame within the vise. Together, the vise and containment mechanism hold the structural frame more firmly than prior art devices. As a result, the frame attachment apparatus is safer and more effective than currently available devices.

The connection member may receive an alignment device, such as a chain assembly, cable, strap, or the like. The connection member may be a hook, hole, or other feature useful for connecting to the attachment apparatus. Connecting an alignment device via the connection member facilitates holding or pulling a portion of the structural frame to which the apparatus is attached. In one embodiment, the alignment device is a hook that receives a chain assembly attached to a pulling tower. The pulling tower exerts a pulling force on the chain assembly, thereby pulling the vise and straightening the portion of the structural frame within the vise.

The frame attachment apparatus may include elements that facilitate increased holding rigidity of the portion of the frame within the vise. In certain embodiments, the vise includes a plurality of grasping digits. The grasping digits are adjustable so that the vise can effectively grasp frame portions of various shapes. In one embodiment, each grasping digit comprises a jaw, and tightening a grasping digit closes the jaw of the digit until contact is made with the frame. The grasping digits may be interchangeable frame-specific digits that may be removed and replaced to match specific frame types. For example, specific digits may have a size and/or contour selected to match a specific frame design.

The jaws of the grasping digits and the vise may include one or more engagement projections that increase the vise's holding pressure on the frame. The frame attachment apparatus may also include a base that secures the vise to an alignment platform, adding further stability to the portion of the frame within the vise.

The containment mechanism may include a strap and ratcheting mechanism that tightens the strap around the portion of the frame. In one embodiment, the ratcheting mechanism is attached to a collar that may be fitted over a post associated with a standard base commonly used in frame alignment systems.

A frame attachment method of the present invention is also presented. The method includes clamping a vise onto a portion of a vehicle frame member and tightening a containment mechanism to secure the vehicle frame member within the vise. This method is more efficient than prior art methods because it requires tightening and loosening of fewer bolts and other fasteners. Increased safety also results because workers operate fewer mechanisms and thus have fewer chances to make mistakes.

Clamping the vise onto a portion of a vehicle frame member may include adjusting grasping digits on the vise to conform to the vehicle frame. Adjusting grasping digits in this manner enables the vise to securely grasp frame portions of various shapes. Other embodiments of the method include attaching an alignment device to the vise and pulling the alignment device to straighten the vehicle frame member. The method may further include removing the alignment device and removing the vise.

In another aspect of the present invention, a frame alignment system includes an alignment platform configured to support a vehicle having a vehicle frame, a vise connected to the alignment platform, the vise having a plurality of grasping digits and the ability to clamp onto a portion of a vehicle frame member, and a containment mechanism that secures the vehicle frame member within the vise. The system may also include a connection member affixed to the vise that receives an alignment device. The various elements of the system work together to enable alignment of a vehicle frame in a fast, safe, and efficient manner.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of fasteners, materials, shapes, sizes, etc., to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Figure 1:
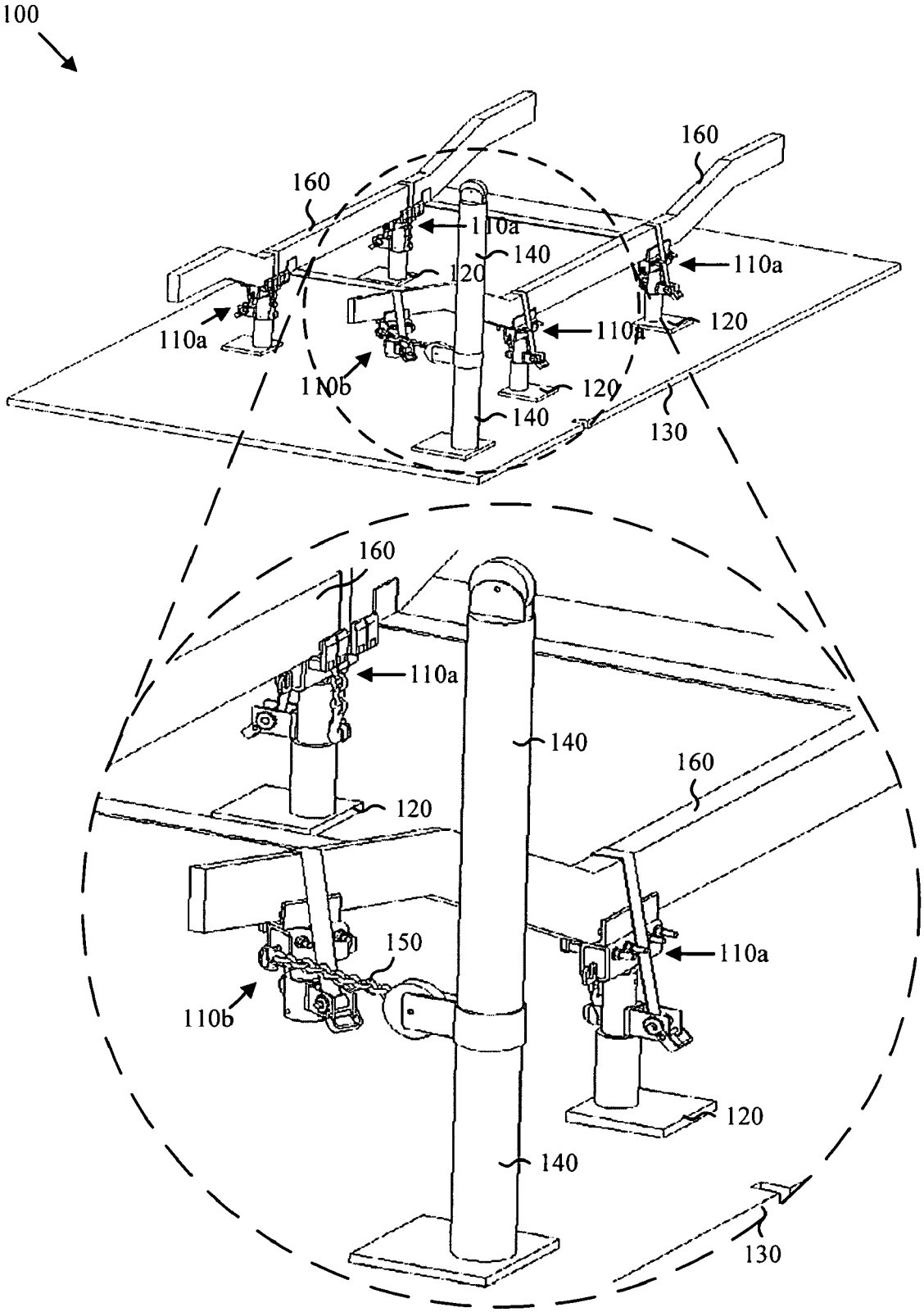
FIG. 1 is an enlarged perspective view illustration depicting one embodiment of a frame alignment system of the present invention.

Referring to the illustrations, FIG. 1 depicts one embodiment of a frame alignment system 100 of the present invention. The frame alignment system 100 includes at least one frame attachment apparatus 110, one or more bases 120, an alignment platform 130, a pulling tower 140, a chain assembly 150, and a structural frame 160. The frame alignment system 100 facilitates aligning automotive structural frames in a safe, efficient manner.

Each frame attachment apparatus 110 attaches to the structural frame 160 at a selected location in order to facilitate alignment. Each frame attachment apparatus 110 may be configured to receive an alignment device such as a chain via a connection member. In this manner the frame attachment apparatus 110 distributes holding or pulling forces from the alignment device to the structural frame 160 more effectively than current art devices.

In the depicted frame alignment system 100, two specific embodiments of the frame attachment apparatus 110 are shown, namely a frame holding apparatus 110*a* and a frame pulling apparatus 110*b*. As depicted, each frame holding apparatus 110*a* connects to the alignment platform 130 via the bases 120, while the depicted frame pulling apparatus 110*b* is coupled to the pulling tower 140 via the chain assembly 150.

The frame holding apparatus 110*a* holds the structural frame 160 in place while the frame pulling apparatus 110*b* facilitates moving a portion of the structural frame 160 into place. As depicted, the frame pulling apparatus 110*b* may be moved to any portion of the structural frame 160 that needs alignment. In the depicted embodiment, the frame pulling apparatus 110*b* transmits alignment forces from the pulling tower 140 to a selected portion of the structural frame 160.

Because the frame attachment apparatus 110 securely attaches to the structural frame 160, slippage of the frame alignment system 100 is less likely to occur than in currently available frame alignment systems. Consequently, the frame alignment system 100 is safer and more reliable than current alignment systems.

Figure 2:
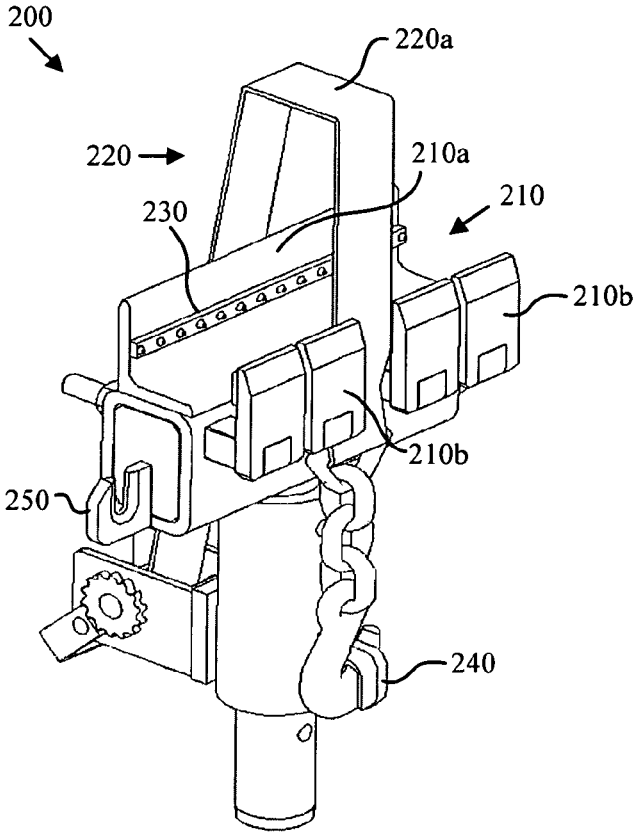
FIG. 2 is a front view perspective illustration depicting one embodiment of a frame attachment apparatus of the present invention.
Figure 3:
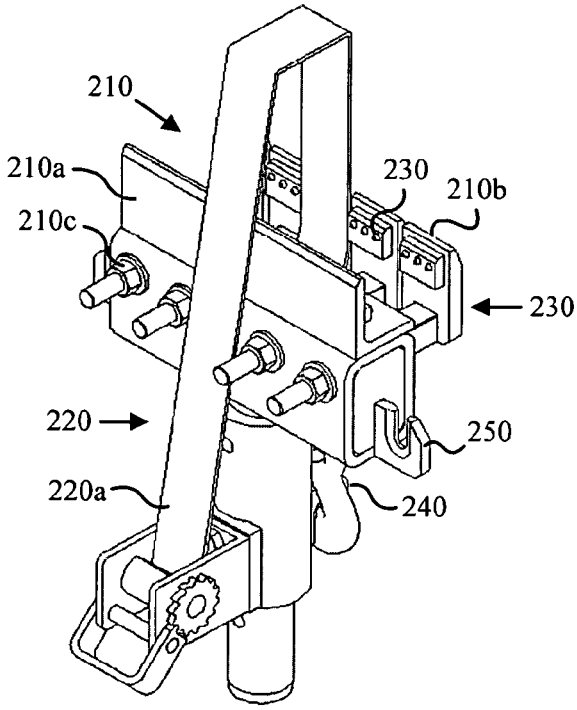
FIG. 3 is a rear view perspective illustration further depicting the frame attachment apparatus of FIG. 2.
Figure 4:
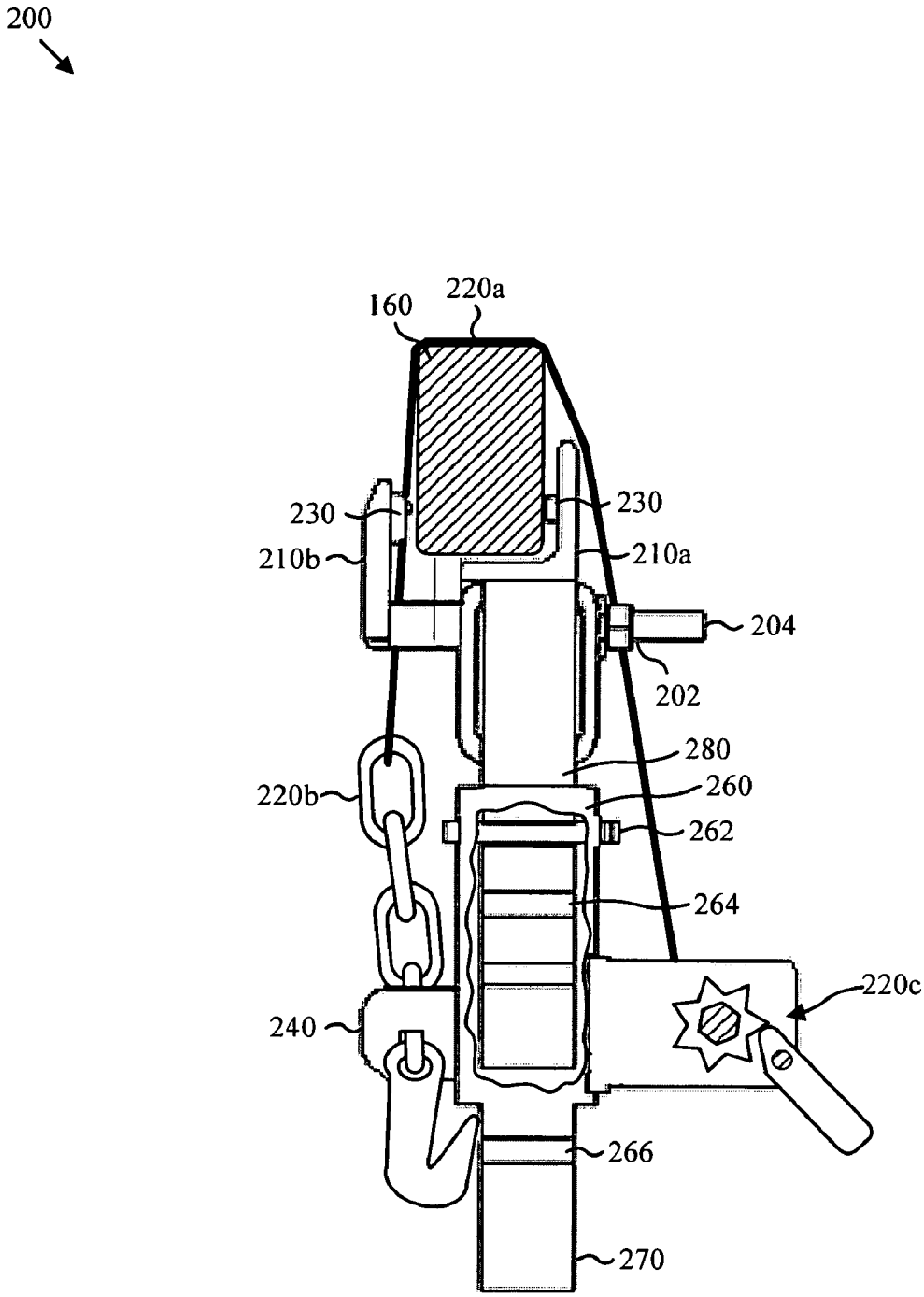
FIG. 4 is a side cutaway view illustration depicting one embodiment of the frame attachment apparatus of FIG. 2.

FIGS. 2 through 4 are illustrations depicting one embodiment of a frame attachment apparatus 200 of the present invention. FIG. 2 depicts a front perspective view, FIG. 3 depicts a rear perspective view, and FIG. 4 depicts a side cutaway view of the frame attachment apparatus 200.

The depicted frame attachment apparatus 200 includes a vise 210, a containment mechanism 220, one or more engagement projections 230, an anchor 240, connection members 250, a stem sleeve 260, a latch pin 262, adjustment holes 264, adjustment holes 266, a stub 270, and a vise stem 280. The vise 210 further includes an opposable member 210*a* and grasping digits 210*b*. In the depicted embodiment, the containment mechanism 220 further includes a strap 220*a*, a chain 220*b*, and a ratcheting mechanism 220*c*.

Within the vise 210, the opposable member 210*a* and the grasping digits 210*b* work together to grasp the structural frame 160 (not shown). While the opposable member 210*a* stays in a fixed position, the grasping digits 210*b* may be adjusted to conform to bends in the structural frame 160. In one embodiment, each grasping digit 210*b* comprises a jaw. Tightening the nut 202 pulls the bolt 204 and closes the jaw of the digit until contact is made with the frame. The nut 202 and the bolt 204 may be adjusted quickly using an air wrench or the like. The grasping digits 210*b* may be interchangeable frame-specific digits that may be removed and replaced to match specific frame types. For example, specific digits may have a size and/or contour selected to match a specific frame design.

The opposable member 210*a* and each grasping digit 210*b* may include one or more engagement projections 230. In the depicted embodiment, the engagement projections 230 are essentially pointed protrusions that improve the gripping surface of the vise 210. The engagement projections 230 may be fashioned from a durable material such as steel, hardened rubber, or the like. Likewise, the vise 210 may be fashioned out of a material able to withstand strong pulling forces, such as tempered steel.

The containment mechanism 220 may be used to partially encompass and contain the structural frame 160 (not shown) and thereby strengthen the grip of the frame attachment apparatus 200 on the structural frame 160. The containment mechanism 220 may include a strap, a chain, a cable, or the like, or any combination thereof. In the depicted embodiment, the containment mechanism 220 includes a strap 220*a* attached to a chain 220*b* as well as a ratcheting mechanism for tightening the strap 220*b*. The chain 220*b* attaches to the anchor 240, and the ratcheting mechanism 220*c* tightens the strap 220*a* and chain 220*b* around the structural frame 160.

The connection members 250 facilitate receiving an alignment device such as the chain assembly 150. The connection members 250 may be hooks, latches, holes, protrusions, or the like capable of receiving an alignment device. The depicted connection members 250 are hooks affixed to each end of the vise. Either one or both of the hooks may receive a chain assembly 150, depending on which direction the structural frame 160 needs to be pulled.

The cutaway view of FIG. 4 illustrates the depicted connection between the vise stem 280 and the stem sleeve or collar 260. The vise stem 280 is welded, bolted, or otherwise attached to the vise 210, and the vise stem 280 includes several adjustment holes 264. When the latch pin 262 is inserted in an adjustment hole 264, the vise stem 280 remains in a rigid position with respect to the stem sleeve 260. When the latch pin 262 is removed from the adjustment hole 264, the vise stem 280 may move vertically within the stem sleeve 260. Thus, the height of the vise stem 280 may adjust to accommodate structural frames 160 of substantially any size.

In the depicted embodiment, the stub 270 is attached to the stem sleeve 260. In another embodiment, the stem sleeve 260 is a collar that is not attached to the stub 270, and the stem sleeve 260 may fit over a standard post associated with a standard frame alignment clamp such as a pinch-weld vise. In the depicted arrangement, the stub 270 may be inserted into the base 120 (not shown) and may be held fast by a second latch pin (not shown) inserted through the adjustment hole 266.

With the stub 270 attached to the base, the frame attachment apparatus 200 functions as the frame holding apparatus 110*a* of FIG. 1. Alternatively, the frame attachment apparatus 200 may not include the stub 270 or may not attach to the base 120. Without the stub 270 or the base 120, the frame attachment apparatus 200 functions as the frame pulling apparatus 110*b* of FIG. 1.

As depicted, the frame attachment apparatus 200 completely encompasses the vehicle structural frame, providing a more secure attachment than current art devices. The frame attachment apparatus 200 is also easy to install and remove, distributes holding or pulling forces effectively, and utilizes existing alignment equipment such as pulling towers, chain assemblies, and the like.

Figure 5:
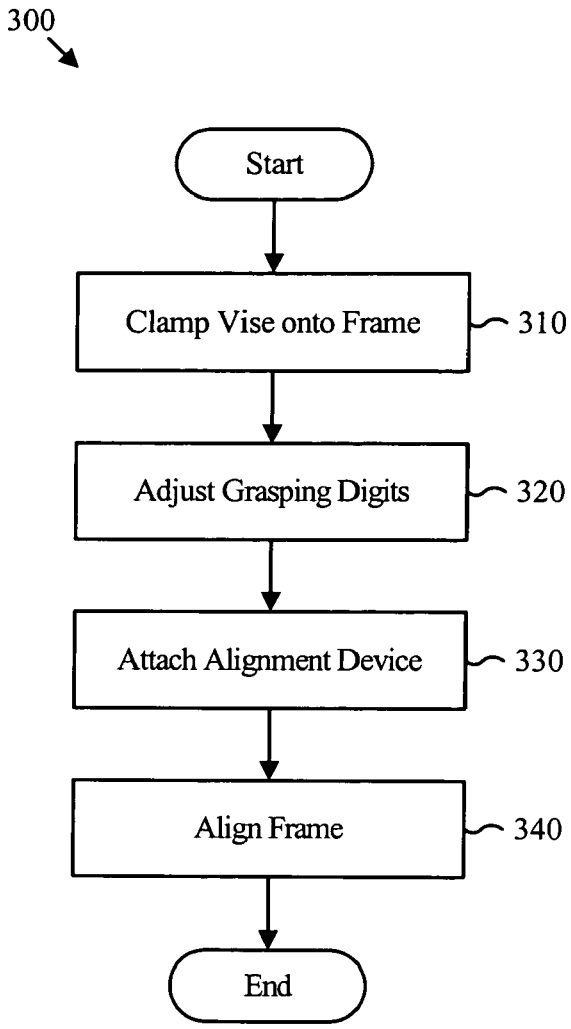
FIG. 5 is a flow chart depicting one embodiment of a frame alignment method of the present invention.

FIG. 5 is a flow chart depicting one embodiment of a frame alignment method 300 of the present invention. The depicted frame alignment method 300 includes a clamp vise onto frame step 310, an adjust grasping digits step 320, an attach alignment device step 330, and an align frame step 340. The frame alignment method 300 facilitates rapid, safe alignment of a structural frame.

The method 300 starts when a vise 210 is clamped onto a structural frame 160. Grasping digits 210*b* may be adjusted 320 to conform to any bend in the structural frame 160. Once the vise 210 is secured to the structural frame 160, an alignment device such as the chain assembly 150 is attached 330 to the vise 210. A pulling tower 140 or other similar device exerts force on the chain assembly 120, which in turn pulls the vise 210 and thereby aligns 340 the structural frame 160.

Figure 6:
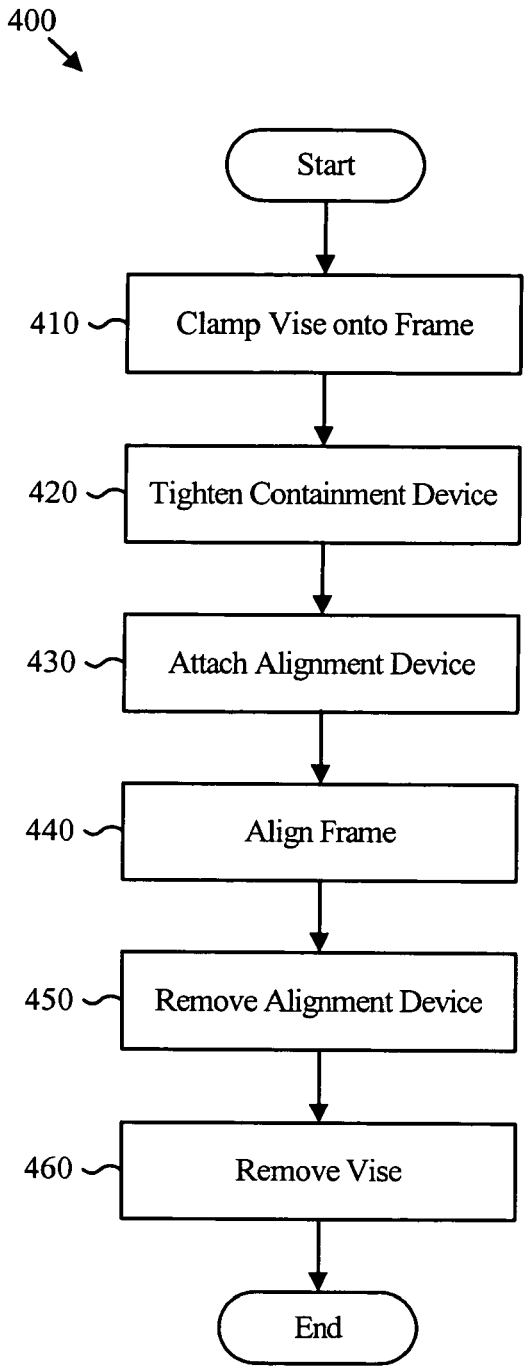
FIG. 6 is a flow chart depicting another embodiment of the frame alignment method of the present invention.

FIG. 6 is a flow chart depicting another embodiment of a frame alignment method 400 of the present invention. The depicted frame alignment method 400 includes a clamp vise onto frame step 410, a tighten containment mechanism step 420, an attach alignment device step 430, an align frame step 440, a remove alignment device step 450, and a remove vise step 460.

The method 400 begins when a vise 210 is clamped 410 onto a structural frame 160. A strap 220*a* or the like attached to the vise 210 is tightened 420 around the structural frame 160 by a ratcheting mechanism 220*c* or other similar device. Once the strap 220*a* is tightened 420, an alignment device such as a chain assembly 150 is attached 330 to the vise 210. A pulling tower 140 or other similar device exerts force on the chain assembly 120, which in turn pulls the vise 210 and thereby aligns 340 the structural frame 160. The chain assembly 120 is then removed from the vise 210, and the vise 210 is removed from the structural frame 160.

Figure 7:
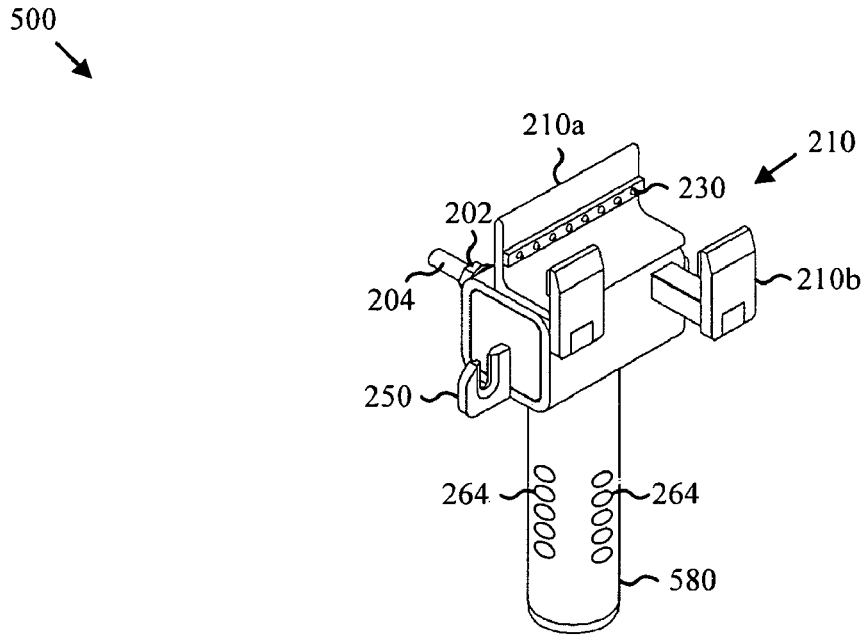
FIG. 7 is a front perspective view depicting another embodiment of the frame attachment apparatus of the present invention.
Figure 8:
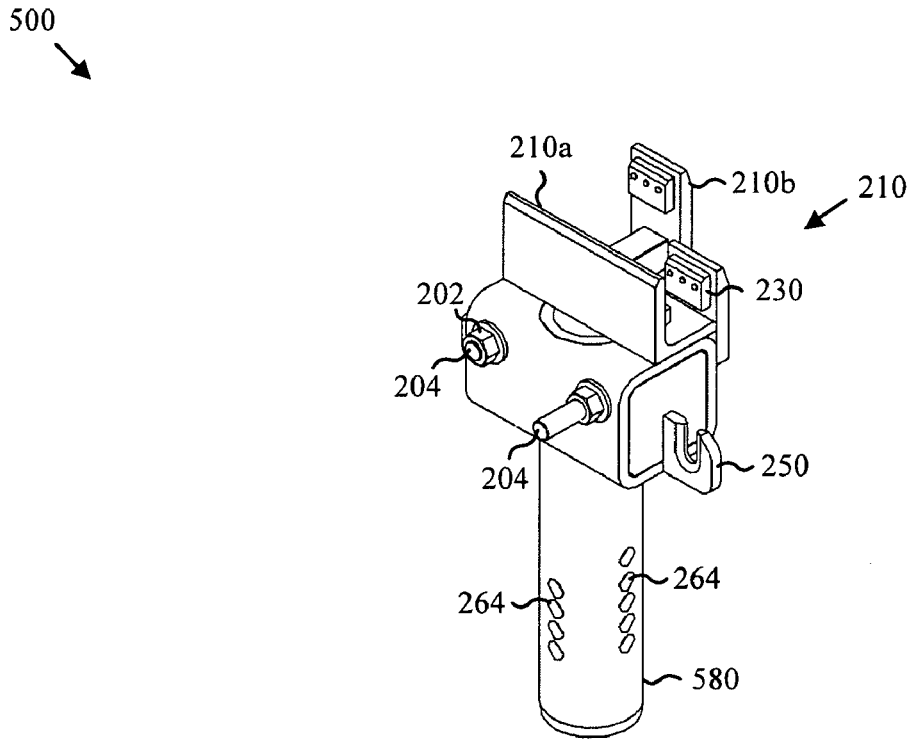
FIG. 8 is a rear perspective view further depicting the frame attachment apparatus of FIG. 7.

FIGS. 7 and 8 are perspective illustrations depicting another embodiment of the frame attachment apparatus of the present invention, namely the frame attachment apparatus 500. FIG. 7 depicts a front perspective view of the frame attachment apparatus 500, while FIG. 8 depicts a rear perspective view of the frame attachment apparatus 500. The depicted frame attachment apparatus 500 includes nuts 202, bolts 204, engagement projections 230, connection members 250, adjustment holes 264, a vise 210, and a vise stem 580.

The vise 210 in the frame attachment apparatus 500 includes fewer grasping digits 210*b* than the vise 210 depicted in FIGS. 2–4. Including fewer grasping digits 210*b*decreases the weight and cost of the frame apparatus 500, though the two grasping digits 210*b* may still grasp frames of various shapes. Additionally, the frame attachment apparatus 500 does not include a containment mechanism 220. The lack of a containment mechanism 220 also contributes to a lighter, cost-effective frame attachment apparatus 500, though the containment mechanism 220 may be added to the frame attachment apparatus 500 if desired.

The functions of the nuts 202, bolts 204, vise 210, engagement projections 230, and connection members 250 are substantially the same as in previous Figures. However, the adjustment holes 264 in the depicted embodiment are in two directions for increased stability of the vise stem 580 within the stem sleeve 260 (not shown).

Figure 9:
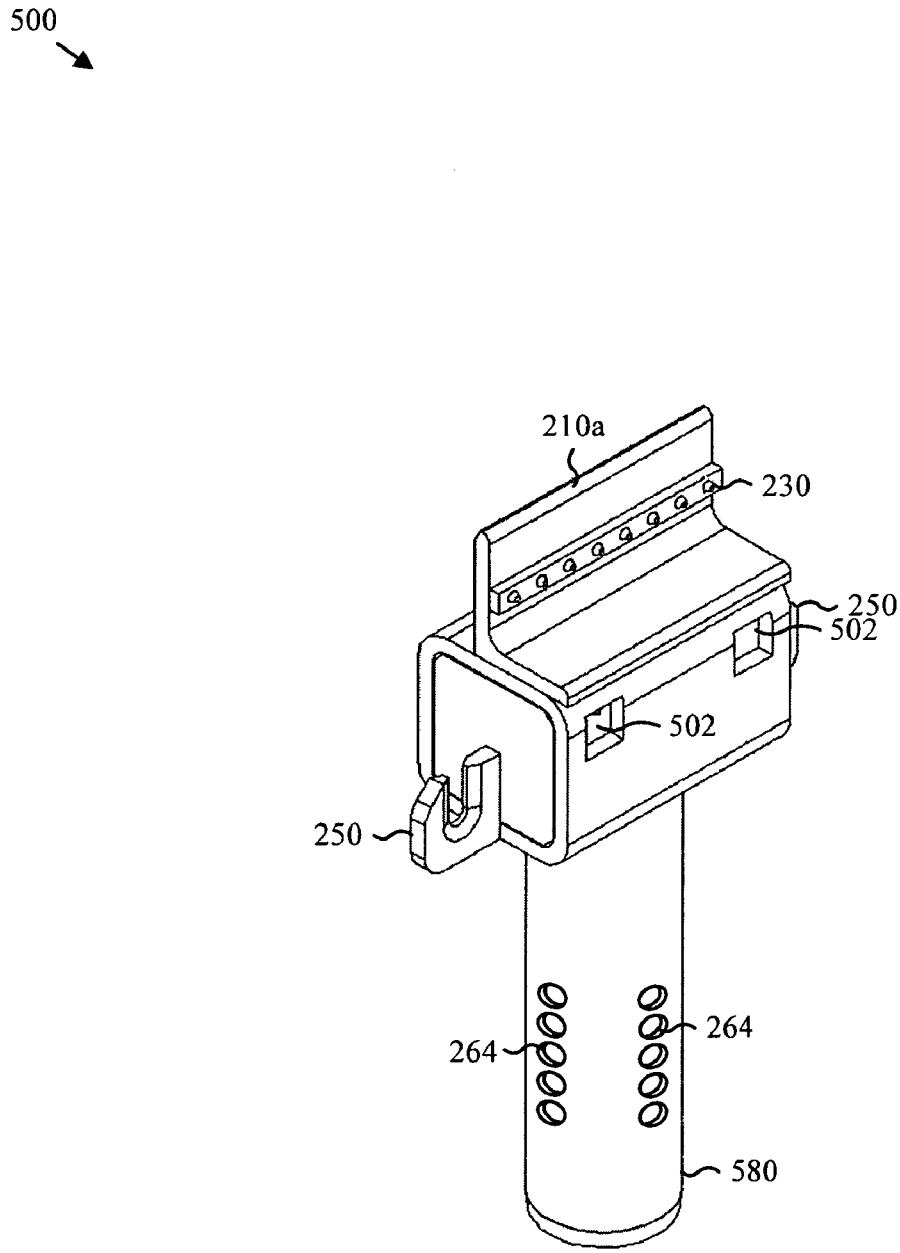
FIG. 9 is a front perspective view depicting portions of the frame attachment apparatus of FIG. 7.

FIG. 9 is a front view perspective illustration depicting selected portions of the frame attachment apparatus 500 of FIG. 7. The depicted frame attachment apparatus 600 includes an engagement projection 230, connection members 250, adjustment holes 264, an opposable member 210*a*, a vise stem 580, and bolt slots 502. The functions of the engagement projection 230, the connection members 250, the adjustment holes 264, the opposable member 210*a*, and the vise stem 580 are substantially the same as previously described. Thus, FIG. 9 essentially depicts one embodiment of the frame attachment apparatus 500 of FIG. 7 without the nuts 202, bolts 204, and grasping digits 210*b*. With these elements removed, the bolt slots 502 are plainly visible.

Each bolt slot 502 may receive a bolt 204 (not shown) attached to a grasping digit 210*b* (not shown). In the depicted embodiment, the bolt slots 502 are square. This square design accommodates bolts 204 with partially square shanks that do not turn within the bolt slots 502. By restricting the bolts 204 from turning, the grasping digits 210*b* attached to the bolts remain rigid against the structural frame 160. Consequently, adjusting the grasping digits 210*b* is facilitated by tightening or loosening the nuts 202 rather than turning the bolts 204. Those familiar with the art will appreciate that many different types of nuts 202, bolts 204, and bolt slots 502 may be used to achieve similar results.

Figure 10:
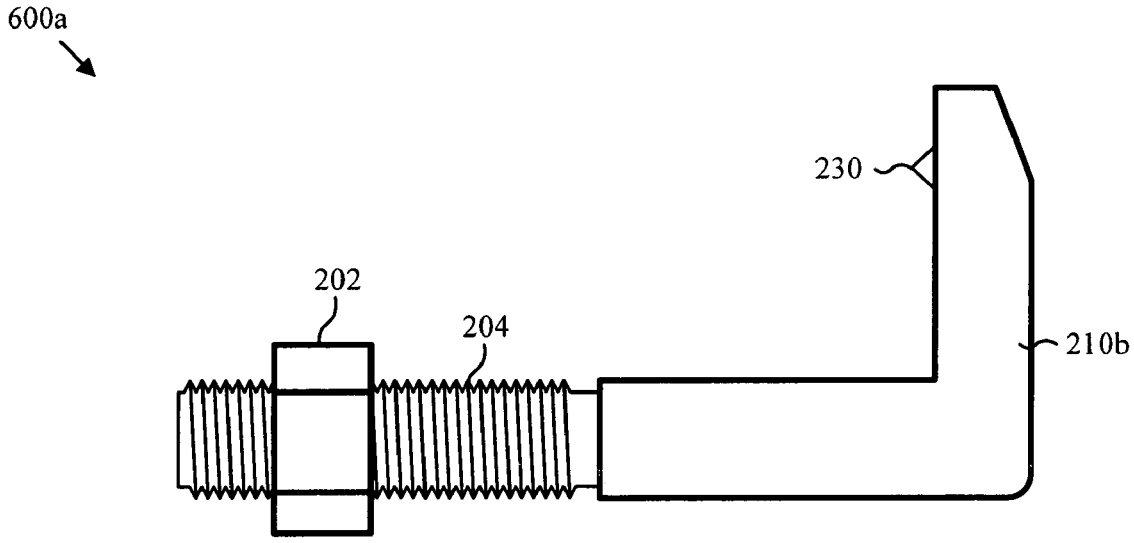
FIG. 10 is a side view depicting a grasping assembly of the present invention.
Figure 11:
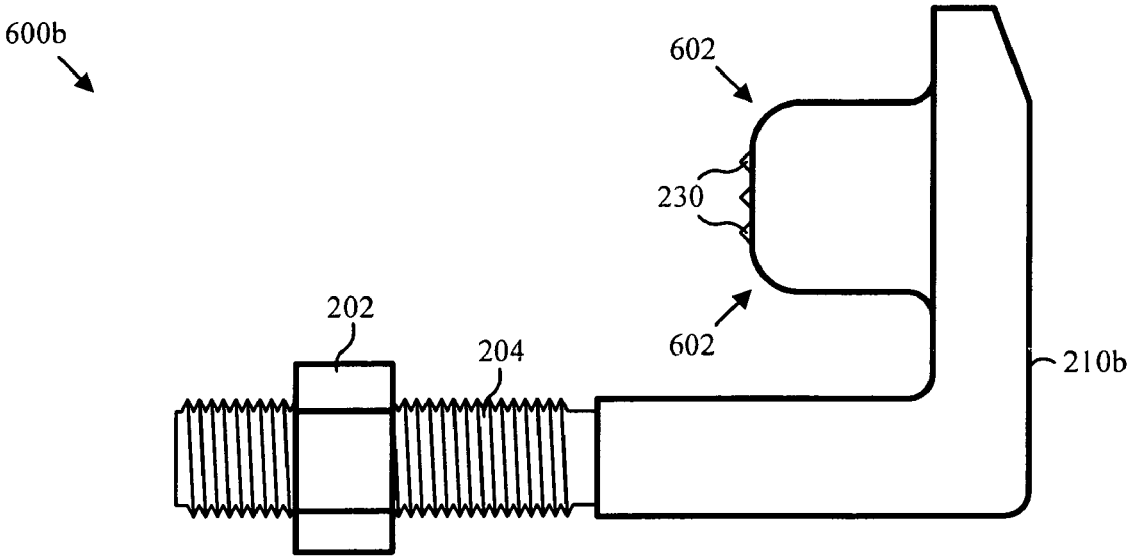
FIG. 11 is a perspective view depicting one embodiment of the grasping assembly of FIG. 10.

FIGS. 10 and 11 depict a grasping assembly 600 of the present invention. The depicted grasping assembly 600 includes a bolt 204, a grasping digit 210*b*, and an engagement projection 230. FIG. 10 depicts a particular embodiment of the grasping assembly 600, namely a claw grasping assembly 600*a*, wherein the grasping assembly 600 further includes a claw 602. Likewise, FIG. 11 depicts a particular embodiment of the grasping assembly 600, namely the non-claw grasping assembly 600*b*, wherein the grasping assembly 600 does not include a claw.

The addition of the claw 602 to the claw grasping assembly 600*a* adds another point of grip on structural frames 160 having a lip (not shown). The claw 602, grasping digit 210*b*, and bolt 204 may be made of tempered steel or other similar material having enough strength to withstand heavy pulling forces.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for attaching to a vehicle frame to facilitate alignment of said frame, the apparatus comprising: a vise comprising a plurality of individually-adjustable grasping digits and at least one opposable member, the vise configured to clamp onto a portion of a vehicle frame member; and a connection member affixed to the vise, the connection member configured to receive an alignment device, and wherein said individually-adjustable grasping digits define grasping digits having a grasping portion and a shank potion, said shank portion having a substantially cylindrically shaped portion and a substantially non-cylindrically shaped portion, and wherein said vise includes a plurality of non-cylindrically shaped grasping digit shank receiving holes, and wherein when a grasping digit non-cylindrically shaped shank portion is received within a non-cylindrically shaped grasping digit shank receiving hole, rotation of a grasping digit is prevented.

2. The apparatus of claim 1, wherein a grasping digit of the plurality of individually-adjustable grasping digits is interchangeable with a frame-specific grasping digit.

3. The apparatus of claim 2, wherein the frame-specific grasping digit comprises a predetermined profile.

4. The apparatus of claim 1, wherein the connection member defines at least one connection member of the following group of connection members comprising a hook and a hole.

5. The apparatus of claim 1, wherein said opposable member defines a rigidly fixed opposable member, and wherein said apparatus is attached to a vehicle frame such that said rigidly fixed opposable member is in grasping contact with an outboard side of said vehicle frame and such that said individually-adjustable grasping digits are in grasping contact with an inboard side of said vehicle frame.

6. The apparatus of claim 1, wherein the alignment device is a chain assembly.

7. The apparatus of claim 1, further comprising a containment mechanism configured to secure the vehicle frame member within the vise.

8. The apparatus of claim 7, wherein the containment mechanism comprises a ratcheting mechanism.

9. The apparatus of claim 7, wherein the containment mechanism comprises a strap.

10. A method for attaching to a vehicle frame to facilitate alignment, the method comprising: providing a vice having a plurality of individually-adjustable grasping digits, said individually-adjustable grasping digits defining grasping digits having a grasping portion and a shank potion, said shank portion having a substantially cylindrically shaped portion and a substantially non-cylindrically shaped portion and said vise defining a vise having a plurality of non-cylindrically shaped grasping digit shank receiving holes, clamping said vise onto a portion of a vehicle frame member, and attaching an alignment device to said vise.

11. The method of claim 10, further comprising tightening a containment mechanism to secure the vehicle frame member within the vise.

12. The method of claim 10, further comprising pulling the alignment device to straighten the vehicle frame member.

13. A system for aligning a vehicle frame, the system comprising: an alignment platform configured to support a vehicle having a vehicle frame; a vise connected to the alignment platform, the vise comprising at least three individually-adjustable grasping digits and at least one opposable member, said individually-adjustable grasping digits defining grasping digits having a grasping portion and a shank potion, said shank portion having a substantially cylindrically shaped portion and a substantially non-cylindrically shaped portion, and said vise including a plurality of non-cylindrically shaped grasping digit shank receiving holes, the vise configured to clamp onto a portion of a vehicle frame member; a containment mechanism configured to secure the vehicle frame member within the vise; and a connection member fixably attached to the vise, the connection member configured to receive an alignment device.

* * * * *